US010858799B2

(12) United States Patent
Jackson et al.

(10) Patent No.: US 10,858,799 B2
(45) Date of Patent: Dec. 8, 2020

(54) TOOL STABILIZER SYSTEM

(71) Applicant: CNH Industrial America LLC, New Holland, PA (US)

(72) Inventors: Jeffrey Jackson, Burlington, IA (US); Christopher Andreuccetti, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 16/260,770

(22) Filed: Jan. 29, 2019

(65) Prior Publication Data

US 2020/0240103 A1 Jul. 30, 2020

(51) Int. Cl.

| | |
|---|---|
| ***E02F 3/30*** | (2006.01) |
| ***E02F 9/22*** | (2006.01) |
| ***E02F 3/43*** | (2006.01) |

(52) U.S. Cl.

CPC ..... *E02F 3/306* (2013.01); *E02F 3/435* (2013.01); *E02F 9/226* (2013.01)

(58) Field of Classification Search

CPC . E02F 3/307; E02F 3/435; E02F 9/226; F15B 11/02; F15B 11/028

USPC ..... 173/189, 190, 193; 60/459

See application file for complete search history.

(56) References Cited

U.S. PATENT DOCUMENTS

| | | | | |
|---|---|---|---|---|
| 5,267,824 | A | 12/1993 | Kishi | |
| 6,422,804 | B1 | 7/2002 | Gitter | |
| 6,915,599 | B2 | 7/2005 | Lohnes et al. | |
| 9,180,558 | B2 * | 11/2015 | Bienfang | B23P 11/00 |
| 9,394,666 | B2 | 7/2016 | Oka | |
| 2016/0298660 | A1 | 10/2016 | Wang et al. | |

FOREIGN PATENT DOCUMENTS

| | | | |
|---|---|---|---|
| KR | 2014145976 | A | 12/2014 |

* cited by examiner

*Primary Examiner* — Thomas E Lazo
*Assistant Examiner* — Daniel S Collins
(74) *Attorney, Agent, or Firm* — Peter Zacharias; Patrick Sheldrake

(57) ABSTRACT

A stabilizer system includes a first object that moves relative to a second object and includes a first actuator coupled to a first wear pad. The first actuator drives the first wear pad to contact a first side of the second object to control motion of the first object relative to the second object. The first actuator operates in a first mode and in a second mode. While operating in the first mode, the first actuator applies a first force to the first wear pad to block the motion of first object relative to the second object. While the first actuator is operating in the second mode, the first actuator applies a second force, lower than the first force, to the first wear pad to enable the motion of the first object relative to the second object.

19 Claims, 4 Drawing Sheets

TOOL STABILIZER SYSTEM

BACKGROUND

The present disclosure relates generally to a stabilizer system of a tool employed by a work vehicle.

Certain work vehicles (e.g., tractors, harvesters, skid steers, etc.) may support tools configured to plow a field, deposit seeds, excavate soil, or accomplish other suitable operations. For example, a work vehicle may support a backhoe tool to excavate soil. Typically, the backhoe tool includes a wear pad system between moving parts to enable the parts to move relative to one another along an actuation direction and to block movement of the parts along other directions (e.g., perpendicular to the actuation direction). The wear pad system may wear over time. As a result, excess play or noise may result, causing frequent, time-consuming, and expensive replacement and/or servicing of the wear pad system. Servicing the wear pad system may involve disassembling components of the backhoe and replacing components of the wear pad system. Servicing the wear pad system by replacing components of the wear pad system may be a labor intensive process that may result in periodic loss of revenue for an enterprise because the work vehicle may not be in operation while the backhoe tool is being serviced.

BRIEF DESCRIPTION

In certain embodiments, a stabilizer system includes a first object that moves relative to a second object and includes a first actuator coupled to a first wear pad. The first actuator drives the first wear pad to contact a first side of the second object to control motion of the first object relative to the second object. The first actuator operates in a first mode and in a second mode. While operating in the first mode, the first actuator applies a first force to the first wear pad to block the motion of first object relative to the second object. While the first actuator is operating in the second mode, the first actuator applies a second force, lower than the first force, to the first wear pad to enable the motion of the first object relative to the second object.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
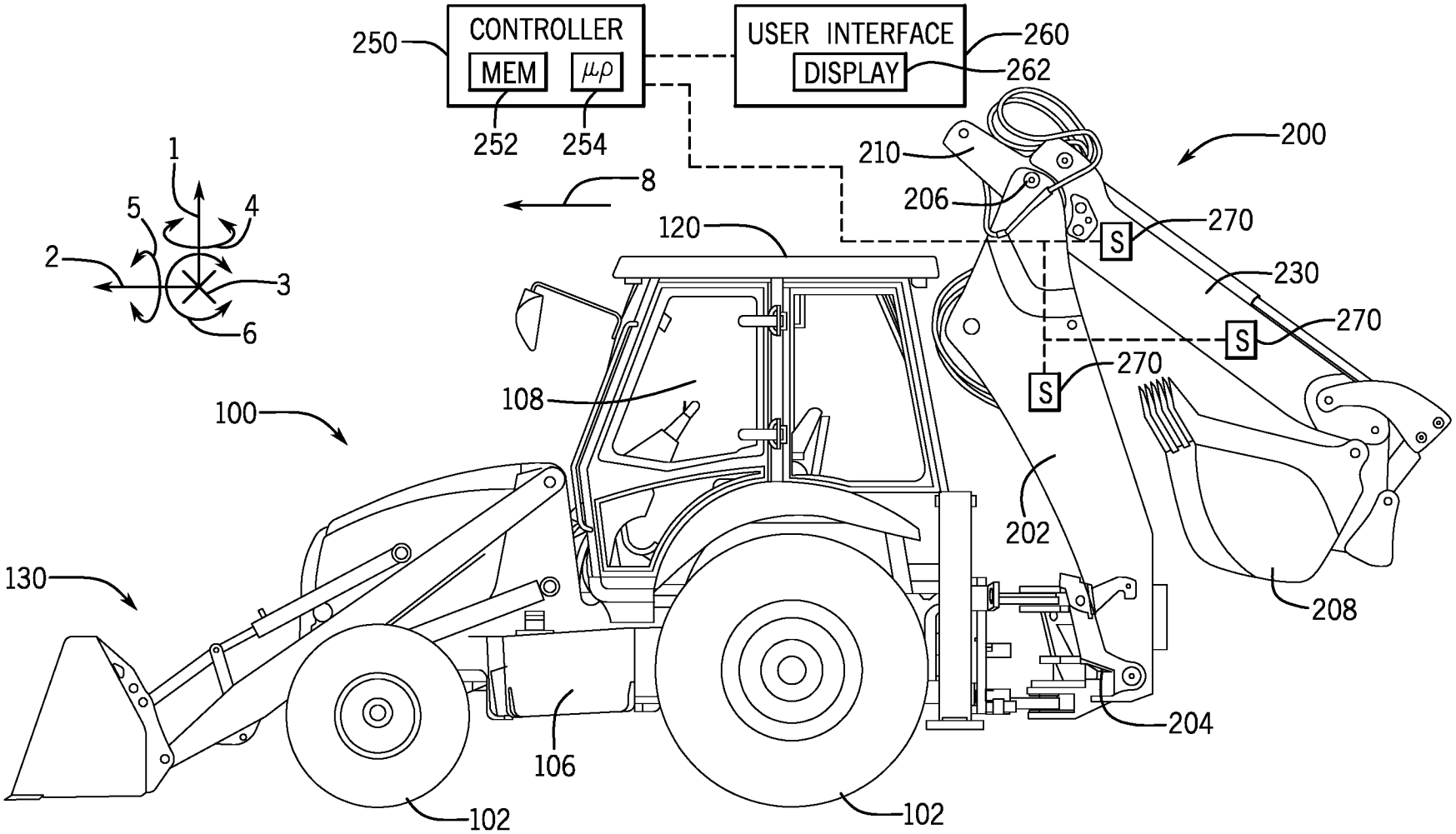
FIG. 1 is a side view of an embodiment of a work vehicle having a backhoe tool that may include a stabilizer system.

Employing a traditional wear pad system on a backhoe tool of a work vehicle may extend the useful life of components of the backhoe tool. For example, the backhoe tool may include a wear pad system between moving parts to enable the parts to move relative to one another along an actuation direction and to block movement of the parts along other directions (e.g., perpendicular to the actuation direction). Additionally, the wear pad system may absorb energy associated with one component of the backhoe tool (e.g., an outer dipper) moving relative to another component (e.g., an inner dipper) of the backhoe tool. In addition or alternatively, the wear pad system may reduce friction associated with the movement of one component of the backhoe tool (e.g., an outer dipper) relative to another component (e.g., an inner dipper) of the backhoe tool. However, as mentioned above, traditional wear pad systems may be frequently serviced (e.g., components of the wear pad system, such as lubricant, wear pads, etc., may be replaced due to wear). For example, servicing these wear pad systems may involve disassembling components of the backhoe and replacing wear pads. Indeed, this labor intensive process may result in loss of productivity for an enterprise because the work vehicle may not be in operation during the wear pads servicing process. As a result, there is a need to improve the systems used to enhance longevity of components in a backhoe tool by reducing or eliminating the labor intensive and frequent maintenance associated with servicing wear pad systems, while maintaining or improving upon the benefits associated with employing wear pads in backhoe tools.

With this in mind, the embodiments described herein, include a stabilizer system that includes multiple hydraulic flow paths configured direct hydraulic fluid to and from respective stabilizer cylinders (e.g., hydraulic cylinders) that increase or decrease a force between a wear pad, which is coupled to an outer dipper (e.g., first object) and an inner dipper (e.g., second object). In some embodiments, when a valve (e.g., a two-position, three-way solenoid valve) is in a first configuration, a hydraulic pump may direct hydraulic fluid from a tank (e.g., hydraulic fluid reservoir) to each of the stabilizer cylinders, thereby increasing force between the wear pad and inner dipper. Furthermore, when the valve is in a second position, the hydraulic fluid may be removed from the stabilizer cylinders and routed back to the hydraulic fluid reservoir, thereby decreasing the force between the wear pad and the inner dipper. In some embodiments, a pneumatic system, an electromechanical system, and the like, may be used instead of or in addition to a hydraulic system. In some embodiments, a controller may receive an indication associated with an input indicative of driving motion of the outer dipper relative to the inner dipper.

In response to receiving this indication to move the outer dipper relative to the inner dipper, the controller may drain fluid from the stabilizer cylinders, for example, to route hydraulic fluid from the stabilizer cylinder to the hydraulic fluid reservoir until the force supplied by the stabilizer cylinders is reduced below a second threshold. In this manner, force between the wear pads and inner dipper may be sufficiently low so as to enable motion of the outer dipper relative to the inner dipper. In addition, the signal that controls the main control valve may be associated with the valve assembly so as to direct hydraulic fluid, via the valve assembly, to the stabilizer cylinders until the force supplied by the stabilizer cylinders exceeds a first threshold force value. In this manner, the stabilizer cylinders may supply sufficient hydraulic fluid to achieve a target force above the first threshold force value to reduce play between the inner and outer dipper, and thereby reduce or prevent unwanted movement of the outer dipper relative to the inner dipper. In other words, when the stabilizer cylinders are pressurized, the wear pad may block movement of the outer dipper relative to the inner dipper. When force of the stabilizer cylinders is reduced, movement of the outer dipper relative to the inner dipper may be enable, but only enough to enable movement of the outer dipper along the actuation direction.

With this in mind, FIG. 1 is a side view of an embodiment of a work vehicle 100 having a backhoe tool 200 that may include one or more stabilizer systems (e.g., hydraulic wear systems). In the illustrated embodiment, the work vehicle 100 is a tractor. However, the backhoe tool 200 and/or the one or more stabilizer systems disclosed herein may be utilized on other work vehicles, such as but not limited to on-road trucks, tractors, harvesters, and construction equipment. Furthermore, in alternative embodiments, the stabilizer system may be used in any tool having a first component that moves relative to a second component, such as boom and dipper assemblies, masts, forklift extensions, and the like. In the illustrated embodiment, the work vehicle 100 includes a cab 120 and a chassis 106. In certain embodiments, the chassis 106 is configured to support a motor (e.g., diesel engine, etc.), a hydraulic system (e.g., including a pump, valves, reservoir, etc.), and other components (e.g., an electrical system, a cooling system, etc.) that may facilitate operation of the work vehicle 100. In addition, the chassis 106 is configured to support the cab 120 and wheels 102. The wheels 102 may rotate to advance and direct the movement of the work vehicle 100 along a direction of travel 8. The wheels 102 may be driven to rotate by the motor and/or by component(s) of the hydraulic system (e.g., hydraulic motor(s), etc.). While the illustrated work vehicle 100 includes wheels 102, in alternative embodiments, the work vehicle may include tracks or a combination of wheels and tracks.

The cab 120 is configured to house an operator of the work vehicle 100. Accordingly, various controls are positioned within the cab 120 to facilitate operator control of the work vehicle 100. For example, the controls may enable the operator to control rotational speed of the wheels 102, thereby facilitating adjustment of the speed and/or the direction of the work vehicle 100. In the illustrated embodiment, the cab 120 also includes a door 108 to facilitate ingress and egress of the operator from the cab 120. Furthermore, the illustrated work vehicle 100 includes a front attachment 130, which may also be controlled (e.g., raised, lowered, etc.) by the controls of the work vehicle 100. While the illustrated work vehicle 100 includes a loader as the front attachment 130, in alternative embodiments, the work vehicle 100 may include an excavator assembly, a tilling assembly, or a gripper assembly, among other tools. The front attachment 130 may employ the stabilizer system described herein.

In the illustrated embodiment, the backhoe tool 200 includes a boom 202, which pivotally couples to the rear end of the work vehicle chassis 106 via a pivot joint 204. Furthermore, the backhoe tool 200 includes an inner dipper 210 coupled to the boom 202 via a pivot joint 206 at a first end of the inner dipper 210. An outer dipper 230 is configured to move relative to the inner dipper 210. For example, the outer dipper 230 may slide along the inner dipper 210. A bucket 208 is coupled to the outer dipper 230 and may excavate soil, carry loads, and the like. In addition, the controls may facilitate operator control of the backhoe tool 200. For example, the controls may enable the operator to control the position of the bucket 208 by moving the outer dipper 230 away from the pivot joint 206, along the inner dipper 210. In another example, the controls may enable the operator to extend the outer dipper 230 along the inner dipper, so as to enable the bucket 208 to excavate at a greater depth.

The boom 202 and inner dipper 210 of the backhoe tool 200 may independently rotate relative to the chassis 106 about a lateral axis 3 in pitch 6 via the respective pivot joints 204 and 206. Furthermore, rotation of the backhoe tool 200 relative to the chassis 106 about the longitudinal axis 2 in roll 5 may be substantially blocked. In some embodiments, the backhoe tool 200 may rotate relative to the chassis 106 about the vertical axis 1 in yaw 4. The backhoe tool 200 may be controlled by the operator of the work vehicle 100. Rotation of the boom 202, rotation of the inner dipper 210, and translation of the outer dipper 230 relative to the inner dipper 210 may each be controlled independently of one another.

The work vehicle 100 includes a controller 250 that includes a memory device 252 configured to store instructions, which may be executed by a processor 254. The controller 250 may also include one or more storage devices and/or other suitable components. The processor 254 may be used to execute software, such as software for controlling aspects of the stabilizer system (e.g., position of valves, configuration of a hydraulic pump, etc.). Moreover, the processor 254 may include multiple microprocessors, one or more "general-purpose" microprocessors, one or more special-purpose microprocessors, and/or one or more application specific integrated circuits (ASICs), or some combination thereof. For example, the processor 254 may include one or more reduced instruction set (RISC) processors.

The memory device 252 may include a volatile memory, such as random access memory (RAM), and/or a nonvolatile memory, such as read-only memory (ROM). The memory device 252 may store a variety of information and may be used for various purposes. For example, as mentioned above, the memory device 252 may store processor-executable instructions (e.g., firmware or software) for the processor 254 to execute, such as instructions for controlling the stabilizer system. The memory device(s) 252 (e.g., nonvolatile storage) may include ROM, flash memory, a hard drive, or any other suitable optical, magnetic, or solid-state storage medium, or a combination thereof. The memory device(s) 252 may store data (e.g., position of the backhoe tool 200, automatic digging schemes, hydraulic specifications of the stabilizer system, etc.), instructions (e.g., software or firmware for controlling relocation operations, etc.), and any other suitable data.

In the illustrated embodiment, the controller 250 is communicatively coupled to a user interface 260 having a display 262. The user interface 260 with the display 262 may be positioned within the cab 120 of the work vehicle 100 and/or at a remote site, for example. The user interface 260 may be communicatively coupled to the controller 250 by a CAN bus, an ISOBUS system, a wireless connection, or any other suitable connection. The user interface 260 may be configured to enable an operator to manually control the digging operations performed by the backhoe tool 200 (e.g., the position of the outer dipper 230 relative to the inner dipper 210). In addition, the display 262 may be configured to present the operator with a graphical representation of the status of the digging operations, the position of the outer dipper 230 relative to the inner dipper 210, a status of the transmission (e.g., engaged for forward movement, parked, neutral, etc.), a status of the stabilizer system (e.g., whether a first threshold force is applied by the stabilizer cylinders or whether a force below a second threshold force is applied by the stabilizer cylinders, etc., as described in detail below), or some combination thereof, for example.

In the illustrated embodiment, various sensor assemblies 270 are positioned at various locations on the work vehicle 100 to detect parameters associated with operation of the work vehicle 100. The sensor assembles 270 are communicatively coupled to the controller 250. The sensor assembly 270 may include an inertial measurement unit (IMU) sensor, steering sensor(s), radar velocity sensor(s), laser sensor(s), sonar sensor(s), infrared sensor(s), capacitance sensor(s), ultrasonic sensor(s), magnetic sensor(s), optical sensor(s), or any other suitable devices configured to detect one or more parameters associated with the work vehicle. In the illustrated embodiment, a sensor assembly 270 is associated with the boom 202, another sensor assembly 270 is associated with the backhoe tool 200, and yet another sensor assembly 270 is associated with the stabilizer system. Although the illustrated embodiment includes three sensor assemblies 270, in further embodiments, the work vehicle may include 1, 2, 5, 6, 10, 25, or any suitable number of sensor assemblies configured to detect any target parameters to facilitate control via the controller.

Figure 2:
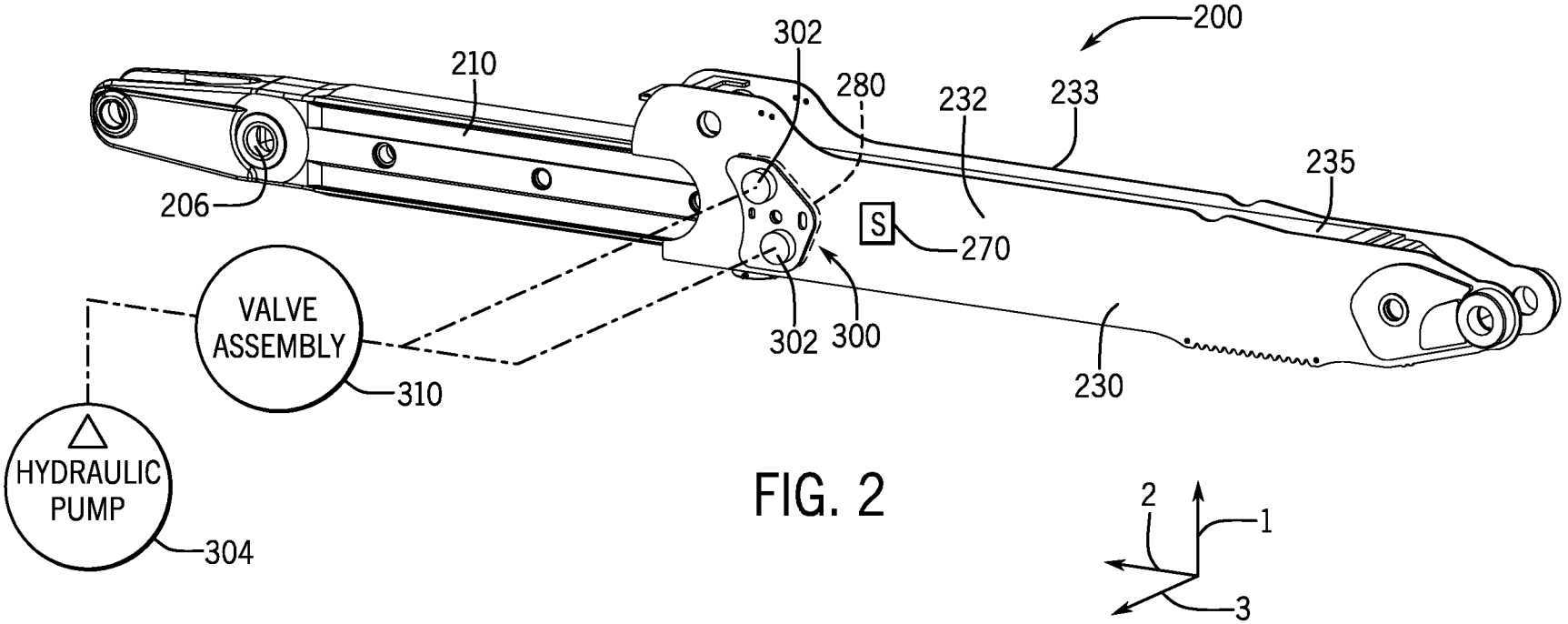
FIG. 2 is a side perspective view of an embodiment of an inner dipper and outer dipper that may be used within the backhoe tool of FIG. 1, including a side stabilizer system.

FIG. 2 is a side perspective view of an embodiment of an inner dipper 210 and an outer dipper 230 that may be employed within the backhoe tool 200 of FIG. 1, including a stabilizer system 300 (e.g., a hydraulic wear system). To facilitate discussion, the illustrated inner dipper 210 and outer dipper 230 are oriented substantially parallel to the ground, such that the outer dipper 230 may translate along the longitudinal axis 2 relative to the inner dipper 210. In other embodiments, the outer dipper may translate relative to the inner dipper along any other suitable direction. The outer surface of the inner dipper 210 may have dimensions configured to facilitate the translation of the outer dipper 230 along a length of the inner dipper 210 (e.g., along the longitudinal axis 2). For example, a height of the inner dipper 210 along the vertical axis 1 and the width of the inner dipper 210 along the lateral axis 3 may be less than the corresponding dimensions of the cavity within the outer dipper 230. In some embodiments, a gap between the inner dipper 210 and the outer dipper 230 may exist to facilitate the translation of the outer dipper 230 along the inner dipper 210.

In the illustrated embodiment, a stabilizer system 300 includes stabilizer cylinders 302 fluidly coupled to a hydraulic pump 304 via a valve assembly 310. As described in detail below with respect to FIG. 3, based on a valve configuration within the value assembly 310, the hydraulic pump 304 may direct hydraulic fluid to the stabilizer cylinders 302. In some embodiments, routing hydraulic fluid to the stabilizer cylinders 302 increases the force exerted by the stabilizer cylinders 302. In some embodiments, the stabilizer system 300 includes a wear pad 280 that may be driven to move by the stabilizer cylinders 302. The stabilizer cylinders 302 may drive the wear pad 280 to exert force on the outer dipper 230 (e.g., inner surface of the outer dipper 230) to block the outer dipper 230 from translating along the longitudinal axis 2, lateral axis 3, or both, relative to the inner dipper 210. For example, the controller 250 may cause the valve assembly 310 to direct hydraulic fluid toward the stabilizer cylinders 302 until the stabilizer cylinders exert a force (as determined by the sensor assembly 270) on the outer dipper 230 that exceeds a first force threshold. When the force exerted by the stabilizer cylinders 302 exceeds the first force threshold, motion of the outer dipper 230 relative to the inner dipper 210 may be blocked. The force applied by the stabilizer cylinders 302 may produce a pressure within the cylinder, such that the force is applied between the inner dipper 210 and wear pad 280. The force may be applied along a vector orthogonal to the direction along which the outer dipper 230 may move relative to the inner dipper absent the force applied by the stabilizer cylinders 302.

The controller may control the force applied by stabilizer system 300 to control the gap (e.g., clearance) between the inner dipper 210 and the wear pad 280, thereby reducing movement between the inner and outer dippers 210, 230 along the lateral axis 3 and/or reducing noise that may result from the movement, while enabling the outer dipper 230 to translate along the longitudinal axis 2 relative to the inner dipper 210.

In the illustrated embodiment, two stabilizer cylinders 302 are positioned on and/or coupled to the first lateral side 232 of the outer dipper 230 and oriented to face the lateral axis 3 so as to apply force inwardly (e.g., toward the inner dipper 210 relative to the outer dipper 230 along the lateral axis 3). The outer dipper 230 also includes a second lateral side 233 and a top side 235 associated. The first lateral side 232 and the second lateral side 233 are positioned on laterally opposite sides of the outer dipper 230. Furthermore, the stabilizer cylinders 302 may be coupled to the outer dipper 230 via any suitable method. For example, in some embodiments, the stabilizer cylinders 302 may be enclosed in respective housings that may be welded to the outer dipper 230. In other embodiments, the stabilizer cylinders 302 may include respective housings bolted to the first lateral side 232 of the outer dipper 230.

Although the current embodiment of the stabilizer system 300 includes two stabilizer cylinders 302 and one wear pad 280, in other embodiments, the stabilizer system 300 may include any suitable number of stabilizer cylinders coupled to the outer dipper and/or wear pads. For example, the backhoe tool may include two, four, six, ten, or any number of suitable number of stabilizer cylinders 302. Further, any suitable number of stabilizer cylinders may exert force on a corresponding wear pad, and/or suitable any number of wear pads 280 may receive the force applied by any suitable number of stabilizer cylinders. For example, two stabilizer cylinders may exert force on a one wear pad, four stabilizer cylinders may exert force on one wear pad, one stabilizer cylinder may exert force on two wear pads, one stabilizer cylinder may exert force on one wear pad, and so forth. In some embodiments, the wear pad may be omitted such that the stabilizer cylinder directly applies force to the inner surface of the outer dipper 230. While the illustrated embodiment only includes stabilizer cylinders 302 on the first lateral side 232, any suitable number of stabilizer cylinders 302 may be positioned on any sides of the outer dipper 230 (e.g., the first lateral side 232, the second lateral side 233, the top side 235, the bottom side, etc.). For example, the first lateral side 232, the second lateral side 233, the top side 235, the bottom side, and other suitable sides of the outer dipper 230 may include any suitable number of wear pads.

Figure 3:
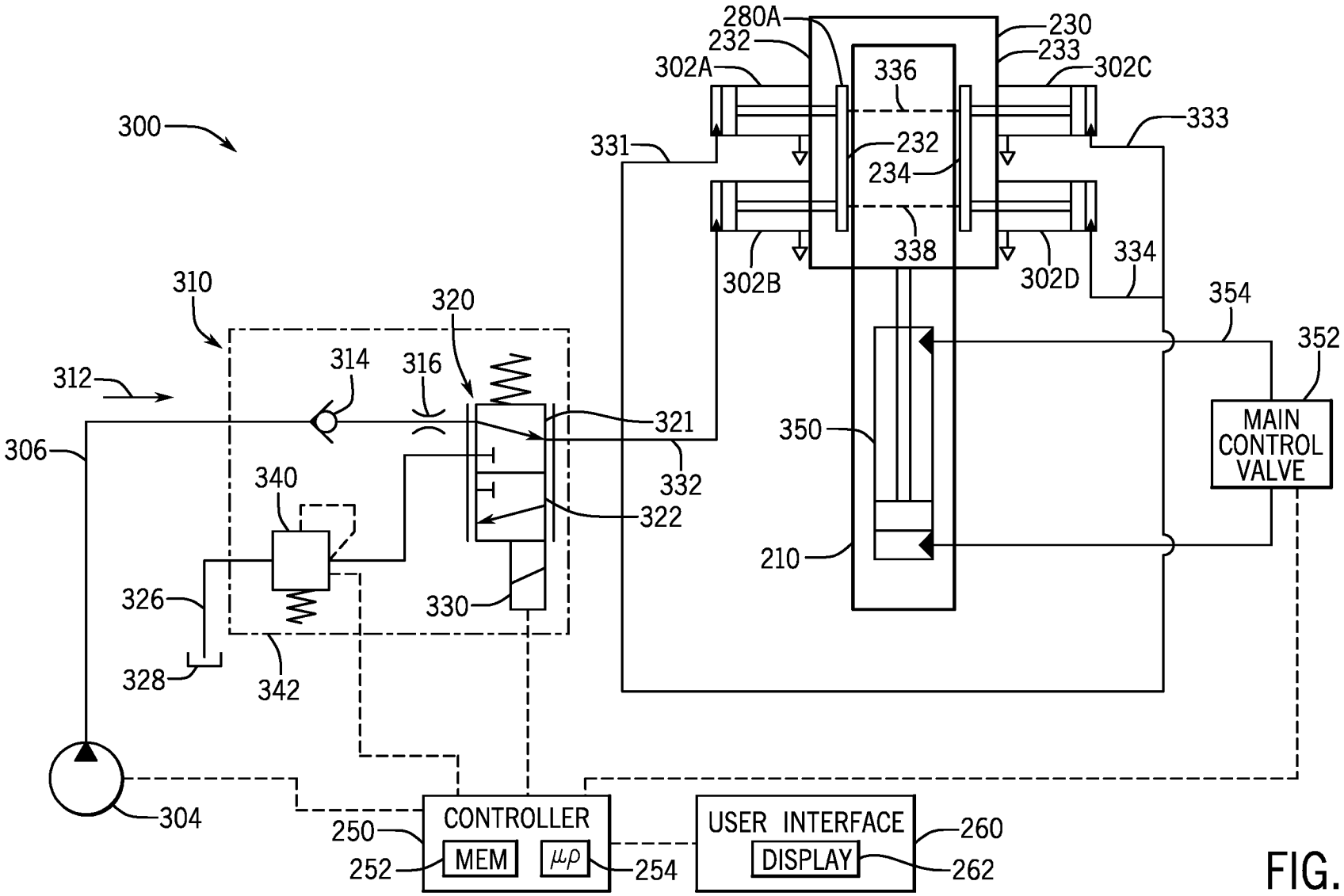
FIG. 3 is a block diagram of an embodiment of a stabilizer system that may be used within the backhoe tool of FIG. 1.

FIG. 3 is a block diagram of an embodiment of a stabilizer system 300 that may be employed within the backhoe tool 200 of FIG. 1. In the illustrated embodiment, the stabilizer system 300 includes the hydraulic pump 304 configured to provide a flow of hydraulic fluid along an initial flow path 306 toward a valve assembly 310 in a first flow direction 312.

The valve assembly 310 includes a check valve 314 (e.g., clack valve, non-return valve, reflux valve, retention valve, or one-way valve) configured to enable the flow of hydraulic fluid along the first flow direction 312. In some embodiments, the check valve 314 blocks fluid flow through the check valve 314 in a direction opposite the first flow direction 312, such that the flow of the hydraulic fluid through the check valve 314 is restricted to only along the first flow direction 312.

Furthermore, the valve assembly 310 includes hydraulic flow restrictor 316. The hydraulic flow restrictor 316 may be (automatically or manually) adjusted to control flow through the hydraulic flow restrictor 316. In certain embodiments, the valve assembly may include a hydraulic divider (e.g., downstream a two-position three-way valve 320). In this manner, if the stabilizer cylinders 302 are the same size and of equal operating parameters, the flow from the pump may divide equally, and as such, the stabilizer cylinders 302 may extend at the same rate. In some embodiments, this equal extension of the stabilizer cylinders 302 occurs until the load on the cylinders changes, at which point the flow goes to the lower-load cylinders. In certain embodiments, to reduce the occurrence of this pressure change within the stabilizer cylinders 302, the stabilizer system 300 may include a pressure-compensated flow control valve to resynchronize the stabilizer cylinders 302. With this in mind, to more easily achieve equal extension and retraction rates of the stabilizer cylinders 302, in some embodiments, the stabilizer cylinders 302 may be of the same size and of equal operating parameters.

To that end, in the illustrated embodiment, the stabilizer system 300 includes four stabilizer cylinders, namely, a first stabilizer cylinder 302A, a second stabilizer cylinder 302B, a third stabilizer cylinder 302C, and a fourth stabilizer cylinder 302D, which all may be of the same size and of equal operating parameters. The first stabilizer cylinder 302A may receive hydraulic fluid via the first hydraulic flow path 331, the second stabilizer cylinder 302B may receive hydraulic fluid via the second hydraulic flow path 332, the third stabilizer cylinder 302C may receive hydraulic fluid via the third hydraulic flow path 333, and the fourth stabilizer cylinder 302D may receive hydraulic fluid via the fourth hydraulic flow path 334. In some embodiments, the first, second, third, and fourth hydraulic flow paths 331, 332, 333, 334 include bidirectional flow paths, such that the hydraulic fluid may flow along the first flow direction 312 and opposite the first flow direction 312.

In the illustrated embodiment, the first and second stabilizer cylinders 302A, 302B may be configured to exert force on a first wear pad 280A to, in turn, exert force on a first lateral side 232 of the inner dipper 210. Additionally, in the illustrated embodiment, the third and fourth stabilizer cylinders 302C, 302D may be configured to exert force on a second wear pad 280B to exert force on a second lateral side 234 of the inner dipper 210, positioned on an opposite side relative to the first lateral side 232. To more evenly distribute the force applied by the stabilizer cylinders 302, the first stabilizer cylinder 302A and the third stabilizer cylinder 302C may apply force in opposite directions (i.e., along the same line 336). Similarly, the second stabilizer cylinder 302B and the fourth stabilizer cylinder 302D may apply force in opposite directions along another same line 338, as illustrated.

As mentioned above, the stabilizer system 300 may include any suitable number of stabilizer cylinders 302. That is, any suitable number of stabilizer cylinders 302 may exert force on a corresponding wear pad 280 and/or any suitable number of wear pads 280. For example, two stabilizer cylinders may exert force on a one wear pad, four stabilizer cylinders may exert force on a one wear pad, one stabilizer cylinder may exert force on two wear pads, and/or one stabilizer cylinder may exert force on one wear pad. In some embodiments, the wear pad may be omitted, and the stabilizer cylinder(s) may apply force directly to the inner surface of the outer dipper. While the illustrated embodiment only includes stabilizer cylinders 302 on the first lateral side 232 and the second lateral side 233, any suitable number of stabilizer cylinders 302 may be positioned on any sides of the outer dipper 230 (e.g., the first lateral side 232, the second lateral side 233, the top side, the bottom side, etc.).

In the illustrated embodiment, the valve assembly 310 includes a two-position three-way valve 320. When the two-position three-way valve 320 is in a first configuration 321 (e.g. first position) the hydraulic fluid may flow along the first flow direction 312 toward the stabilizer cylinders 302. When the two-position three-way valve 320 is in a second configuration 322 (e.g. second position) the hydraulic fluid may flow back (via an outlet flow path 326) to a tank 328 (e.g., hydraulic fluid reservoir) storing the hydraulic fluid from the stabilizer cylinders 302. In other embodiments, any other suitable valve, instead of a two-position three-way valve, may be used in lieu of or in addition to the two position two-position three-way valve.

To facilitate changing between the two configurations (e.g., positions) of the two-position three-way valve 320, in the illustrated embodiment, the valve assembly 310 includes solenoid 330 associated with the two-position three-way valve 320. In some embodiments, the solenoid 330 may be an electromechanical device communicatively coupled to the controller 250 and configured to control the configuration of the two-position three-way valve 320 to regulate fluid flow through the two-position three-way valve 320.

When the two-position three-way valve 320 is in the first configuration 321 (e.g. first position) the hydraulic pump 304 may direct hydraulic fluid from the pump 304 along the first flow direction 312 toward the stabilizer cylinders 302. In some embodiments, the controller 250 may actuate the solenoid 330 to configure the two-position three-way valve 320 to be in the first configuration 321 (e.g. first position) until the force supplied by the stabilizer cylinders 302 exceeds a first threshold force value. The first threshold force may be a pre-determined force at which play between the inner and outer dipper 210, 230 is reduced to prevent movement of the outer dipper 230 relative to the inner dipper 210.

In some embodiments, the controller 250 may apply sufficient force via the stabilizer cylinders 302 so as to prevent the outer dipper 230 from moving relative to the inner dipper 210. The controller 250 may hold the valve assembly 310 in a first position until receipt of a signal to move the outer dipper 230 relative to the inner dipper 210, at which point the force applied by the stabilizer cylinders 302 is reduced to achieve the target motion.

In the illustrated embodiment, the valve assembly 310 includes a relief valve 340 (e.g., pressure relief valve). The relief valve 340 may control or limit the pressure in the stabilizer system 300 by controlling the pressurized hydraulic fluid flow from the stabilizer cylinders 302 toward the tank 328 via the outlet flow path 326. The controller 250 may set the relief valve 340 to open at a predetermined set pressure to cause the stabilizer cylinders 302 to apply a force to the wear pads that enables movement of the outer dipper 230 relative to the inner dipper 210 along the longitudinal axis 2, while reducing movement along the lateral axis 3.

In the illustrated embodiment, a dipper stabilizer cylinder 350 is fluidly coupled to a main control valve 352 via a flow path 354. The dipper stabilizer cylinder 350 may be coupled to the inner dipper 210 and to the outer dipper 230. In some embodiments, the dipper stabilizer cylinder 350 may be larger than the stabilizer cylinders 302. The dipper stabilizer cylinder 350 is configured to drive the outer dipper 230 to move relative to the inner dipper 210.

The main control valve 352 is configured to direct fluid to the dipper stabilizer cylinder 350. For example, the main control valve 352 may be communicatively coupled to the controller 250, such that the controller 250 may actuate the main control valve 352 to control the position of the outer dipper. In some embodiments, the controller 250 may configure the two-position three-way valve 320 to a first configuration 321 (e.g. first position) to increase and/or maintain the force applied by the stabilizer cylinders 302 so as to prevent motion of the outer dipper 230 relative to the inner dipper 210 in response to a control signal to terminate motion of the outer dipper 230. Accordingly, the hydraulic fluid may flow (via an outlet flow path 326) from the tank 328 (e.g., hydraulic fluid reservoir) storing the hydraulic fluid toward the stabilizer cylinders 302 to increase the force applied or the hydraulic fluid. In some embodiments, the controller 250 may configure the two-position three-way valve 320 to a second configuration 322 (e.g. second position) to reduce the force applied by the stabilizer cylinders 302 so as to control motion of the outer dipper 230 in response to a control signal to move the outer dipper 230. Accordingly, the hydraulic fluid may flow back (via an outlet flow path 326) to the tank 328 (e.g., hydraulic fluid reservoir) storing the hydraulic fluid from the stabilizer cylinders 302.

In the illustrated embodiment, the controller 250 is communicatively coupled to the hydraulic pump 304, the hydraulic flow restrictor 316, the relief valve 340, the solenoid 330, and the main control valve 352. The controller 250 may control the hydraulic pump 304 to control the force applied by the stabilizer cylinders 302 by controlling the fluid to the stabilizer cylinders 302. Additionally or alternatively, the controller 250 may control the hydraulic flow restrictor 316 to control the pressure in the stabilizer cylinders 302 by controlling the fluid to the stabilizer cylinders 302. Additionally or alternatively, the controller 250 may control the solenoid 330 to control the pressure in the stabilizer cylinders 302 by controlling the fluid to and from the stabilizer cylinders 302. Additionally or alternatively, the controller 250 may control the relief valve 340 to control the pressure in the stabilizer cylinders 302 by controlling the fluid from the stabilizer cylinders 302. The various components of the stabilizer system 300 may include corresponding sensor assemblies that may determine various operating parameters (e.g., positions, pressures, flow rates, etc.) that may be communicated to the controller 250 to further facilitate control of the force applied by the stabilizer cylinders 302. In further embodiments, the controller 250 may control any aspect of the work vehicle 100.

Figure 4:
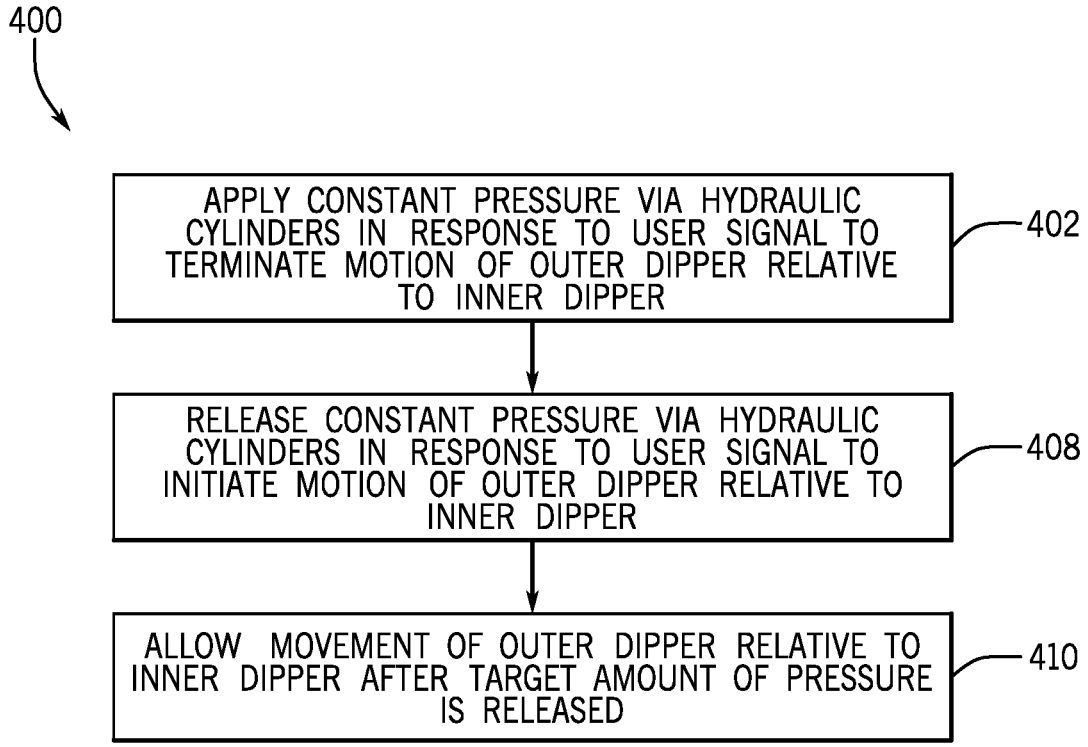
FIG. 4 is a flow diagram of an embodiment a method to control the force applied by stabilizer cylinders of the stabilizer system.

FIG. 4 is a flow diagram 400 of an embodiment of a method to control the force applied by stabilizer cylinders of the stabilizer system. The method in the illustrated embodiment may be performed by the controller of the work vehicle or a remote controller. The controller may include a processor and a memory device. The memory device may include instructions stored therein that may be executed by the processor to perform the method in the illustrated embodiment. With this in mind, the controller may receive, from sensor assemblies associated with the work vehicle and the stabilizer system, operating parameters associated with operation of the work vehicle and the stabilizer system. For example, the controller may receive a position of the outer dipper relative to the inner dipper, a configuration (e.g., valve position) of and a flow rate through various valves (e.g., the two-position three-way valve, the relief valve, the main control valve, etc.), a respective force applied by the stabilizer cylinders, and so forth.

The controller may apply (process block 402) a constant force via the stabilizer cylinders in response to a first control signal (e.g., user input to the user interface) to terminate motion of the outer dipper relative to the inner dipper. The first control signal may include an indication that the user wishes the outer dipper remain fixed relative to the inner dipper, for example, to perform excavating operations. Additionally or alternatively, the first control signal may include an indication that the user wishes to terminate motion of the outer dipper relative to the inner dipper. In some embodiments, a user input to perform an excavating operation may be associated to the first control signal.

In some embodiments, the controller may actuate the valve assembly to direct hydraulic fluid from the dipper stabilizer cylinder toward the stabilizer cylinders to increase the force applied by the stabilizer cylinders until the force exceeds a first force threshold, at which point motion of the outer dipper relative to the inner dipper may terminate, such that motion of the outer dipper relative to the inner dipper is restricted to prevent the outer dipper from sliding along the inner dipper. In response to motion of the outer dipper relative to the inner dipper being restricted, the backhoe tool may more efficiently and effectively perform excavating operations because unwanted play between the outer dipper and inner dipper may be reduced.

The controller may cause the stabilizer cylinders to release (process block 408) hydraulic fluid in response to a user input to initiate motion of the outer dipper relative to the inner dipper (e.g., motion along the length of the inner dipper). For example, the controller may cause the main control valve to extend the dipper stabilizer cylinder to cause hydraulic fluid to drain from the stabilizer cylinders back to the tank until the force the stabilizer cylinders exert on the inner dipper is reduced so as to allow motion of the outer dipper relative to (e.g., translate along) the inner dipper. For example, the user input may include a control signal to extend or retract the outer dipper relative to the inner dipper, at which point the controller may reduce or increase (or maintain) the force applied by the stabilizer cylinders as described above. In this manner, when the force applied by the stabilizer cylinders is reduced to a target value, movement of the outer dipper relative to the inner dipper may be enabled (process block 410), while reducing unwanted play between the inner dipper and outer dipper (e.g., reducing motion along a lateral axis).

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A stabilizer system, comprising:

a first object configured to move relative to a second object;

a first actuator coupled to a first wear pad, the first actuator configured to drive the first wear pad to contact a first side of the second object to control motion of the first object relative to the second object; and a controller communicatively coupled to the first actuator, the controller comprising a processor and a memory device comprising instructions stored thereon that when executed by the processor are configured to cause the processor to:

in a first mode apply a first force with the first actuator to substantially block the motion of the first object relative to the second object in response to receiving a first control signal indicative of terminating the motion of the first object relative to the second object; and in a second mode apply a second force lower than the first force with the first actuator to enable the motion of the first object relative to the second object in response to receiving a second control signal indicative of imitating the motion of the first object relative to the second object.

2. The stabilizer system of claim 1, wherein the first actuator is fluidly coupled to a fluid reservoir and configured to receive fluid from the fluid reservoir, and a force applied by the first actuator is based on a pressure of the fluid received by the first actuator.

3. The stabilizer system of claim 2, further comprising a valve assembly comprising a main control valve configured to control the motion of the first object relative to the second object along an actuation direction oriented along a length of the second object in response to the second control signal indicative of driving the motion of the first object relative to the second object.

4. The stabilizer system of claim 1, wherein the first force and the second force are each applied along a direction orthogonal to an actuation direction of the first object relative the second object.

5. The stabilizer system of claim 1, wherein the motion of the first object relative to the second object is oriented longitudinally along a length of the second object.

6. The stabilizer system of claim 1, wherein the first object is an outer dipper of a backhoe boom, and the second object is an inner dipper of a backhoe boom.

7. The stabilizer system of claim 3, wherein the valve assembly is fluidly coupled to a fluid tank reservoir and configured to control a flow of the fluid between the fluid reservoir and the first actuator to control the first and second forces applied by the first actuator.

8. The stabilizer system of claim 7, wherein the controller is communicatively coupled to the valve assembly and configured to control a position of the valve assembly to control the flow of the fluid between the fluid reservoir and the first actuator to control the first and second forces applied by the first actuator in response to the first and second control signals, respectively, and wherein the first and second forces are configured to control the motion of the first object relative to the second object.

9. The stabilizer system of claim 7, wherein the valve assembly further comprises a two-position, three-way valve configured to:

direct the fluid from the fluid tank reservoir to the first actuator while in a first configuration; and direct the fluid from the first actuator to the fluid tank reservoir while in a second configuration.

10. A stabilizer system, comprising:

a first object configured to move relative to a second object;

a first actuator coupled to a first wear pad, the first actuator configured to drive the first wear pad to contact a first side of the second object to control motion of the first object relative to the second object, the first actuator further configured to operate in a first mode and in a second mode, the first actuator configured to apply a first force to the first wear pad to block the motion of first object relative to the second object while the first actuator is operating in the first mode, and the first actuator configured to apply a second force, lower than the first force, to the first wear pad to enable the motion of the first object relative to the second object while the first actuator is operating in the second mode; and a second actuator coupled to a second wear pad, the second actuator configured to operate in the first mode and in the second mode, the second actuator configured to apply the first force to the second wear pad so as to block the motion of the first object relative to the second object while the first actuator and the second actuator are operating in the first mode, and the second actuator configured to apply the second force, lower than the first force, to the second wear pad to enable the motion of the first object relative to the second object while the first actuator and the second actuator are operating in the second mode.

11. The stabilizer system of claim 10, wherein the second actuator is configured to drive the second wear pad to contact a second side of the first object to control the motion of the first object relative to the second object, and wherein the second side is positioned opposite the first side.

12. The stabilizer system of claim 10, wherein the second actuator is configured to drive the first wear pad to contact the first side of the first object to control the motion of the first object relative to the second object.

13. A method to control a force applied by one or more actuators of a stabilizer system of a work vehicle, wherein the method comprises:

instructing, via a controller, a valve assembly of the stabilizer system to apply a force, by the one or more actuators, to substantially block motion of a first object relative to a second object of a backhoe tool of the work vehicle in response to receiving a first control signal indicative of terminating the motion of the first object relative to the second object;

instructing, via the controller, the valve assembly of the stabilizer system to reduce the force applied by the one or more actuators to enable the motion of the first object relative to the second object in response to receiving a second control signal indicative of imitating the motion of the first object relative to the second object; and actuating, via the controller, the first object to move along an actuation direction oriented along a length of the second object so as to extend or shorten a dig length of the backhoe tool in response to the second control signal.

14. The method of claim 13, further comprising initiating, via the controller, excavating operations in response to the one or more actuators maintaining the force.

15. The method of claim 13, wherein instructing the valve assembly of the stabilizer system to apply the force to substantially block the motion comprises actuating the one or more actuators to apply the force to one or more wear pads.

16. A controller of a work vehicle, the controller communicatively coupled to one or more actuators and a sensor assembly of a stabilizer system, the controller comprising a processor and a memory device comprising instructions stored thereon that when executed by the processor are configured to cause the processor to:

instruct a valve assembly of the stabilizer system to apply a force, by the one or more actuators, to substantially block motion of a first object relative to a second object of a backhoe tool of a work vehicle in response to receiving a first control signal indicative of terminating motion of the first object relative to the second object; and instruct the valve assembly of the stabilizer system to reduce the force applied by the one or more actuators to enable the motion of the first object relative to the second object in response to receiving a second control signal indicative of initiating the motion of the first object relative to the second object.

17. The controller of claim 16, wherein the force applied by the one or more actuators is applied to one or more wear pads.

18. The controller of claim 16, wherein the instructions are configured to actuate the first object to drive the motion of the first object along an actuation direction oriented along a length of the second object so as to extend or shorten a dig length of the backhoe tool in response to the second control signal.

19. The controller of claim 18, wherein the force applied by the one or more actuators is applied along an application direction orthogonal to the actuation direction.

* * * * *